US007341486B2

(12) United States Patent
Onoda et al.

(10) Patent No.: US 7,341,486 B2
(45) Date of Patent: Mar. 11, 2008

(54) ELECTRICAL CONNECTOR

(75) Inventors: Katsuhiko Onoda, Shizuoka (JP); Masanobu Oishi, Shizuoka (JP); Tomokazu Yamane, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 30 days.

(21) Appl. No.: 11/482,849

(22) Filed: Jul. 10, 2006

(65) Prior Publication Data

US 2007/0049101 A1 Mar. 1, 2007

(30) Foreign Application Priority Data

Aug. 31, 2005 (JP) ..... 2005-251791

(51) Int. Cl.
*H01R 13/40* (2006.01)

(52) U.S. Cl. ..... 439/595; 439/352; 439/752

(58) Field of Classification Search ..... 439/352, 439/595, 752, 381, 871, 744, 752.2, 924.1, 439/137, 141, 140, 149
See application file for complete search history.

(56) References Cited

U.S. PATENT DOCUMENTS

| | | | | |
|---|---|---|---|---|
| 6,146,200 | A * | 11/2000 | Ito et al. | 439/596 |
| 6,685,506 | B1 * | 2/2004 | Nakamura et al. | 439/595 |
| 6,764,334 | B2 * | 7/2004 | Tsuji et al. | 439/595 |
| 6,811,436 | B2 * | 11/2004 | Tabata | 439/595 |
| 6,811,437 | B2 * | 11/2004 | Nimura | 439/595 |

FOREIGN PATENT DOCUMENTS

| | | |
|---|---|---|
| JP | 10-312853 | 11/1998 |
| JP | 2002-324613 | 11/2002 |
| JP | 3387438 | 1/2003 |
| JP | 3634111 | 1/2005 |

* cited by examiner

*Primary Examiner*—Edwin A. Leon
(74) *Attorney, Agent, or Firm*—Kratz, Quintos & Hanson, LLP

(57) ABSTRACT

A connector housing body has a terminal receiving chamber. A projecting terminal has a terminal base received in the terminal receiving chamber and a projecting portion projecting from the housing body. A front body covers the projecting portion of the terminal. The front body has the terminal insertion hole through which the projecting portion of the terminal is extended. L locking means are provided in the housing body and the front body for finally locking the front body to the housing body at a final locking position where the projecting portion of the terminal is extended from the insertion hole. The locking means preliminarily locks the front body at the preliminary locking position where a leading end of the projecting portion of the terminal is positioned with a less distance from the front body than at the final locking position. At the preliminary locking position, the projecting portion of the terminal is not extended from the terminal insertion hole of the front body. Even when the projecting portion of the projecting terminal a little extends from the front body, the extended length is smaller than at the final locking position.

5 Claims, 7 Drawing Sheets

ELECTRICAL CONNECTOR

BACKGROUND OF THE INVENTION

1. Field of the Invention

The present invention relates to an electrical connector, particular to an electrical connector having a projecting terminal and a housing body formed with a terminal receiving chamber, and the projecting terminal is received in the terminal receiving chamber and locked by a locking lance.

2. Related Art

FIGS. 8 and 9 show such a conventional electrical connector disclosed in Japanese Patent Application Laid-open No. 2002-324613. FIG. 8 is a sectional view showing the connector 100. FIG. 9 is a perspective, sectional view of a housing body 12 constituting the connector 100. The connector 100 serves to connect a female connector (not shown) to a male terminal 21 projected on a base plate 20.

As shown in the drawings, the connector 100 has the housing body 12 provided with a projecting terminal T. The projecting terminal T has a terminal base 11*b* received in the terminal receiving chamber and a projection portion 11*a* extending from an opening 12*a* of the housing body 12. The projecting terminal T has a male terminal part defining the projection portion 11*a* engaged with a female terminal of another connector (not shown), and the projecting terminal T has a female terminal part defining the terminal base 11*b* engaged with the male terminal 21 of the base board via an inner opening 12*b*. That is, the projecting terminal has the male and female terminal parts.

The connector 100 has a cylindrical case 13 receiving the housing body 12. The housing body 12 has a length so that a leading end of the projection portion 11*a* may be extended from a projection opening 13*a* of the case 13. The case 13 has a locking protrusion 13*b* for locking a housing of an associated female connector (not shown).

A leading end of the projection portion 11*a* of the connector 100 is extended from the projection opening 12*a* of the housing body 12. The projection portion 11*a* is exposed externally when the case 13 is removed for packaging or transporting the housing body 12 having the terminal T. This possibly causes deformation of the projection portion 11*a*. Particularly, when the projection portion 11*a* has a smaller diameter, deformation of the projection portion 11*a* occurs more likely.

Such conventional connectors are also disclosed in Japanese Patent Laid-open No. H-10-312853, Japanese Patent No. 3634111, and Japanese Patent No. 3387438.

SUMMARY OF THE INVENTION

Therefore, an object of the present invention is to provide a connector, which can prevent deformation of a projecting terminal of the connector during packaging and transportation thereof.

For achieving the object, the present invention provides an electrical connector that includes:

a housing body having a terminal receiving chamber, a projecting terminal having a terminal base received in the terminal receiving chamber and a projecting portion extending from the housing body, a front body covering the projecting portion of the terminal and having a terminal insertion hole through which the projecting portion of the terminal is extended, and locking means provided in the housing body and the front body for finally locking the front body to the housing body at a final locking position where the projecting portion of the terminal is extended from the insertion hole when the front body is moved from the projecting portion to the terminal base to be attached to the housing body, the locking means preliminarily locking the front body at a preliminary locking position where a leading end of the projecting portion of the terminal is positioned with a less distance from the front body than at the final locking position.

In the invention, the housing body has the terminal receiving chamber. The projecting terminal has the terminal base received in the terminal receiving chamber and the projecting portion projecting from the housing body.

The front body surrounds the projecting portion of the terminal. The front body has the terminal insertion hole through which the projecting portion of the projecting terminal is extended. The locking means finally locks the front body to the housing body at the final locking position where the projecting portion of projecting terminal is extended from the insertion hole when the front body is moved from the projecting portion to the terminal base to be attached to the housing body. The locking means preliminarily locks the front body at the preliminary locking position where the leading end of the projecting portion of the projecting terminal is positioned nearer to the front body than at the final locking position. Thus, at the preliminary locking position, the projecting portion of the terminal can not be extended from the terminal insertion hole of the front body. Even when the projecting portion of the terminal slightly extends from the front body, the extended length is smaller than that at the final locking position. Hence, the front body can protect the projecting terminal from an impacting force. At the final locking position, the projecting portion of the terminal extends from the terminal insertion hole of the front body to connect an opposed terminal. At the preliminary locking position, the connector is packaged and transported without deformation of the projecting terminal.

Preferably, the locking means are configured such that the leading end of the projecting terminal is positioned not to extend from the terminal insertion hole at the preliminary locking position where the front body is preliminarily locked to the housing body.

Thereby, at the preliminary locking position, the projecting terminal does not extend from the terminal insertion hole of the front body. Thus, the connector is packaged and transported without deformation of the projecting terminal.

Preferably, the locking means are configured such that the leading end of the projecting terminal is positioned in the terminal insertion hole at the preliminary locking position where the front body is preliminarily locked to the housing body.

Thereby, at the preliminary locking position, the projecting terminal does not extend from the terminal insertion hole of the front body, and the front body has a minimum length from the terminal base of the housing body, reducing the size of the connector.

Preferably, a larger thickness one and a smaller thickness one of the projecting terminals are provided. The smaller projecting terminal is smaller than the larger projecting terminal in sectional area. The smaller projecting terminal has a leading end positioned in a rear side of a leading end of the larger projecting terminal, and the projecting portion of the larger projecting terminal extends from the terminal insertion hole while the leading end of the smaller projecting terminal is not extended from the terminal insertion hole at the preliminary locking position.

Thereby, at the preliminary locking position, the smaller terminal that is weak against an impacting force does not extend from the terminal insertion hole. Meanwhile, the larger terminal extends from the terminal insertion hole so that the front body has a length less than a case where the larger terminal does not extend from the terminal insertion hole. This reduces the size of the connector.

Preferably, the front body has a cover for covering an outer side surface of the housing body, and the locking means are separately provided in the cover of the front body and in the outer side surface of the housing body.

Thereby, at the preliminary locking position, the cover of the front body also protects the projecting terminal. The locking means provided on the cover and the housing body can be easily arranged. By this simple construction, the connector is packaged and transported without deformation of the projecting terminal.

Preferably, the terminal insertion hole has an inner periphery formed with a tapered surface to define an open sectional area decreasing along an insertion direction of the projecting terminal, the tapered surface positioned in a side of the terminal receiving chamber.

Thereby, the projecting terminal is aligned with and inserted into the tapered inner peripheral surface of the terminal insertion hole so that the projecting terminal can be easily passed through the terminal insertion hole.

Preferably, the connector has a case receiving the housing body and the front body and engaging with an opposed connector housing having an opposed terminal.

Thereby, the case can engage with the opposed connector.

DETAILED DESCRIPTION OF THE PREFERRED EMBODIMENTS

Figure 1:
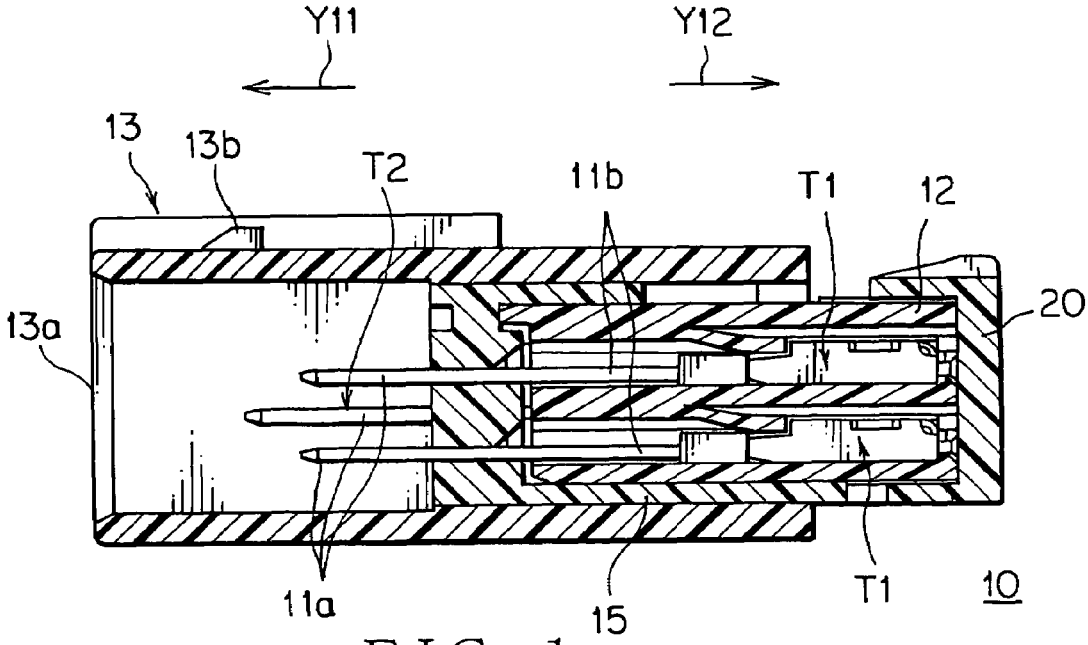
FIG. 1 is a sectional view showing an embodiment of an electrical connector according to the present invention.
Figure 2A:
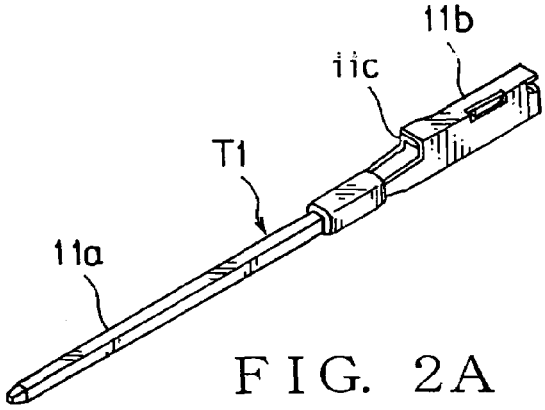
FIGS. 2A and 2B each are a perspective view showing each of a smaller projecting terminal and a larger projecting terminal constituting the connector according to the present invention.
Figure 2B:
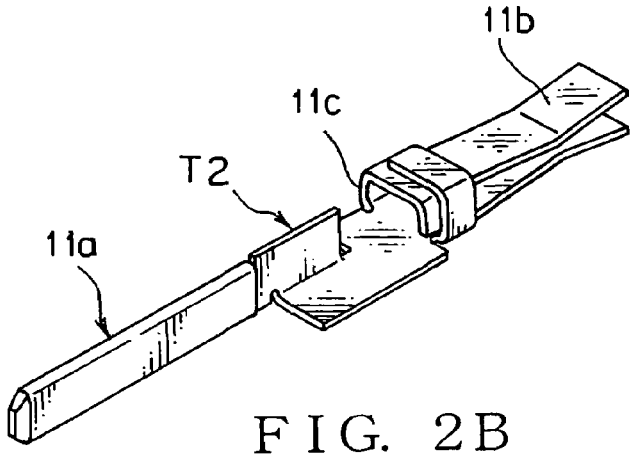
Figure 3A:
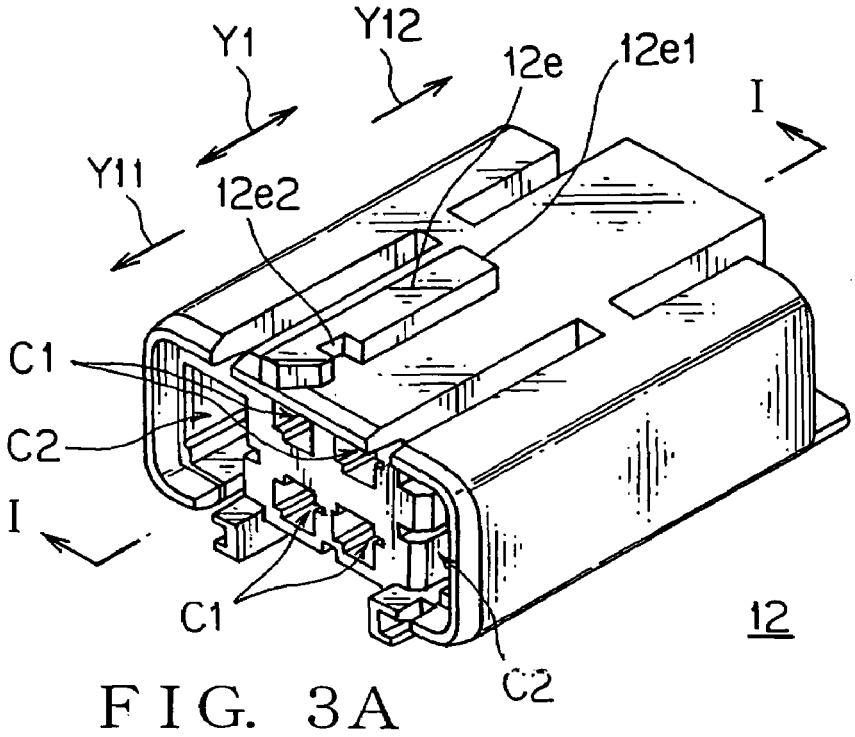
FIG. 3A is a perspective view showing a housing body constituting the connector.
Figure 3B:
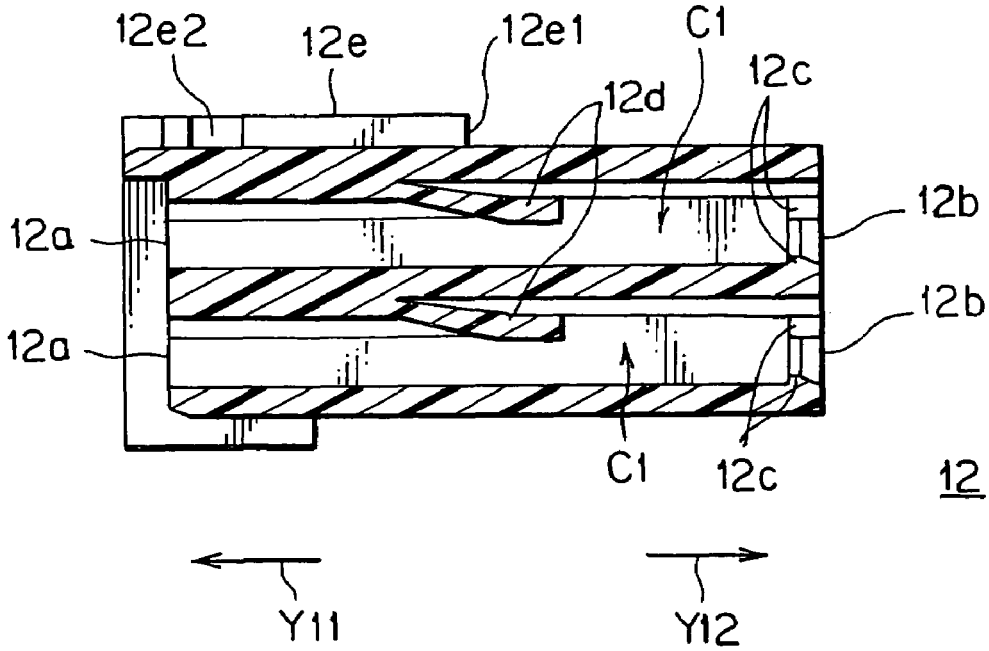
FIG. 3B is a sectional view taken along line I-I of the housing body of FIG. 3A.

Referring to the accompanied drawings, an embodiment of the present invention will be discussed. FIG. 1 is a sectional view showing an embodiment of an electrical connector 10 according to the present invention. FIGS. 2A and 2B each are a perspective view showing each of a smaller thickness terminal T1 and a larger thickness terminal T2 constituting the connector according to the present invention. FIG. 3A is a perspective view showing a housing body housing body 12 constituting the connector 10, and FIG. 3B is a sectional view taken along line I-I of the housing body 12 of FIG. 3A.

Figure 4A:
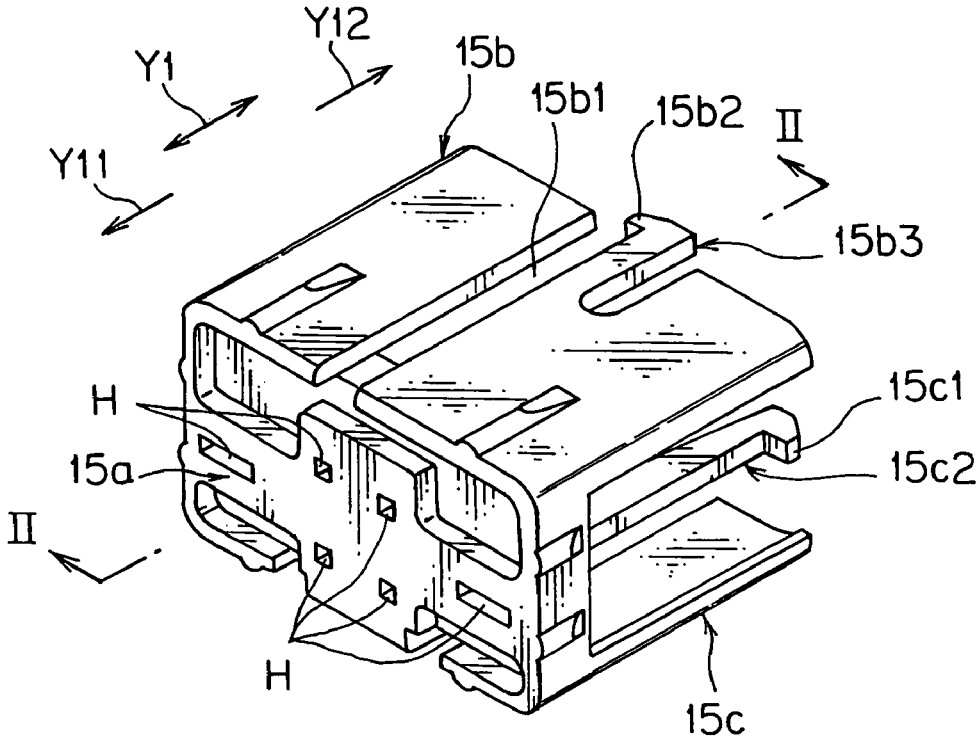
FIG. 4A is a perspective view showing a front body constituting the connector.
Figure 4B:
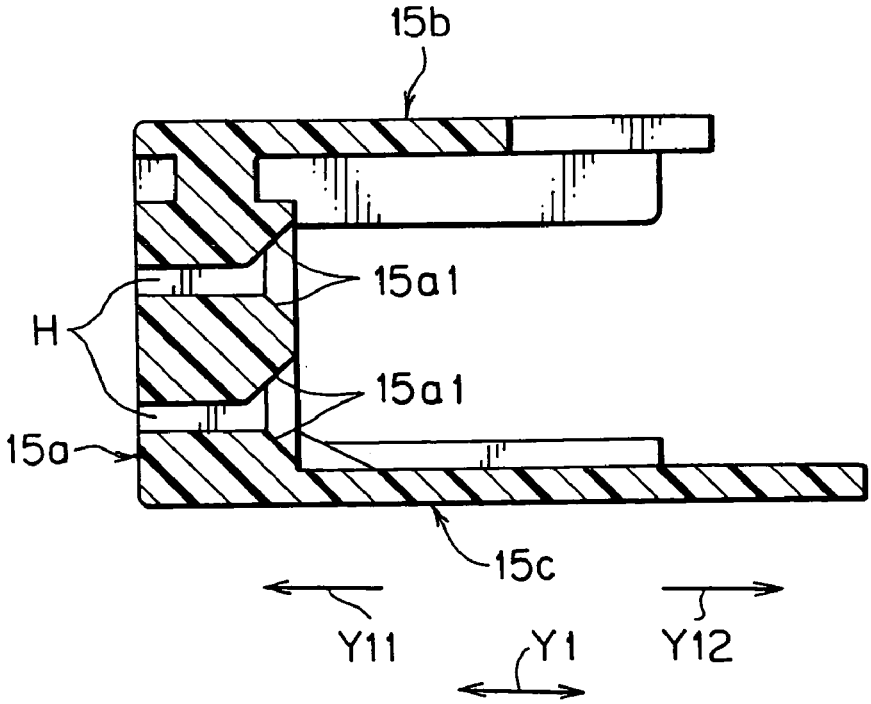
FIG. 4B is a sectional view taken along line II-II of the front body of FIG. 4A.
Figure 5A:
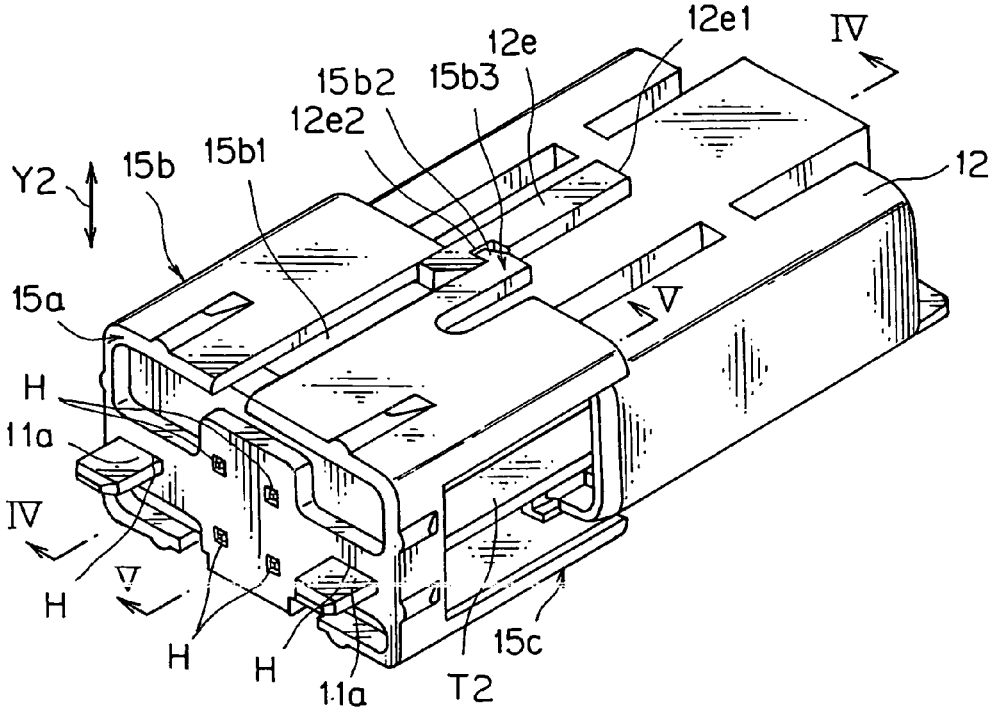
FIG. 5A is a perspective view showing the front body preliminarily locked to the housing body.
Figure 5B:
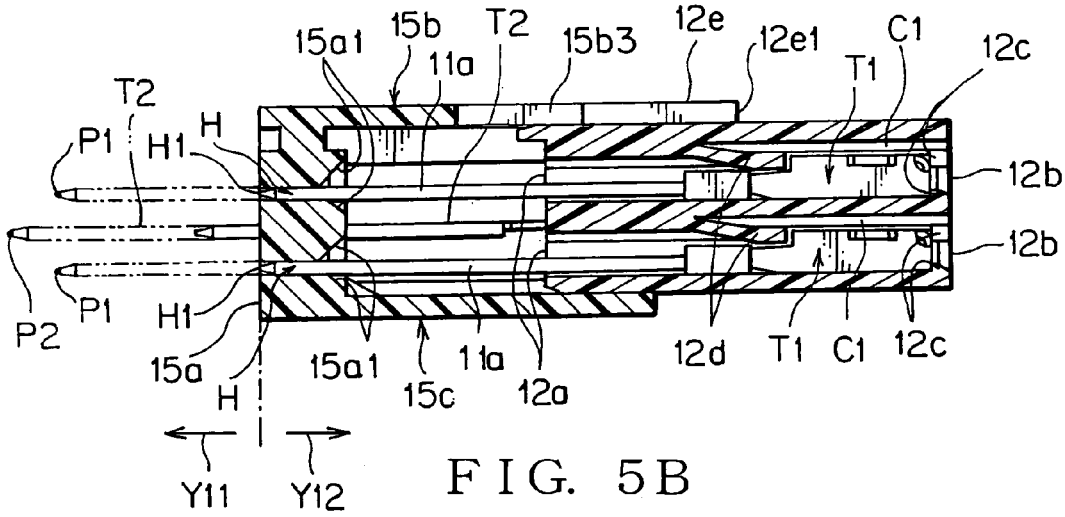
FIG. 5B is a sectional view taken along line IV-IV of the housing body and the front body of FIG. 5A.
Figure 6A:
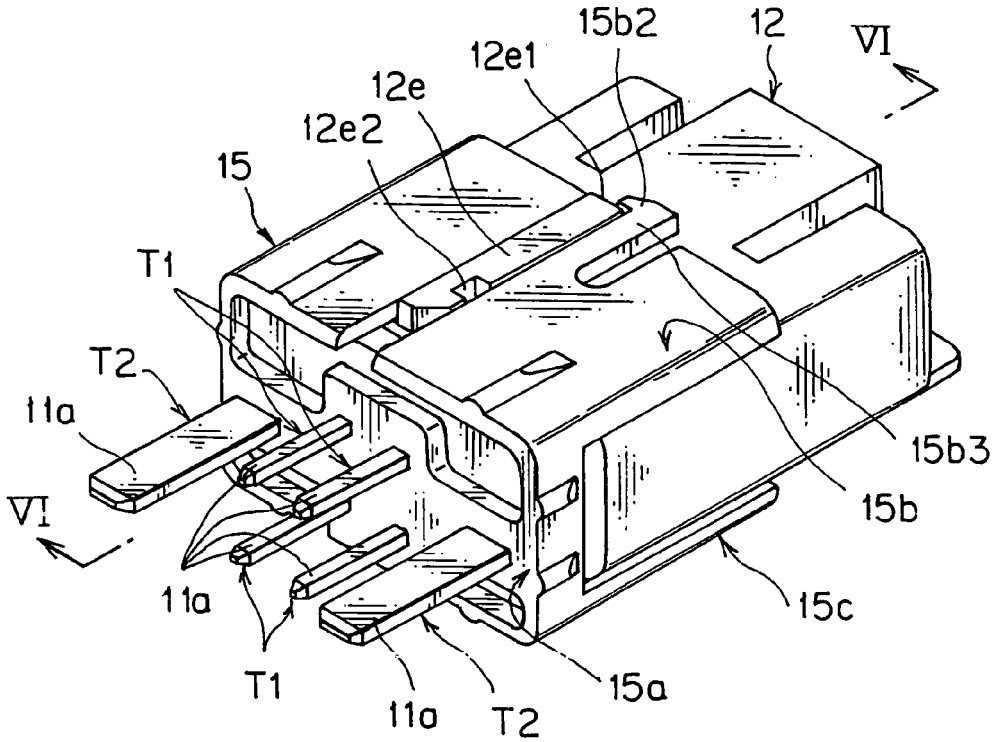
FIG. 6A is a perspective view showing the front body finally locked to the housing body.
Figure 6B:
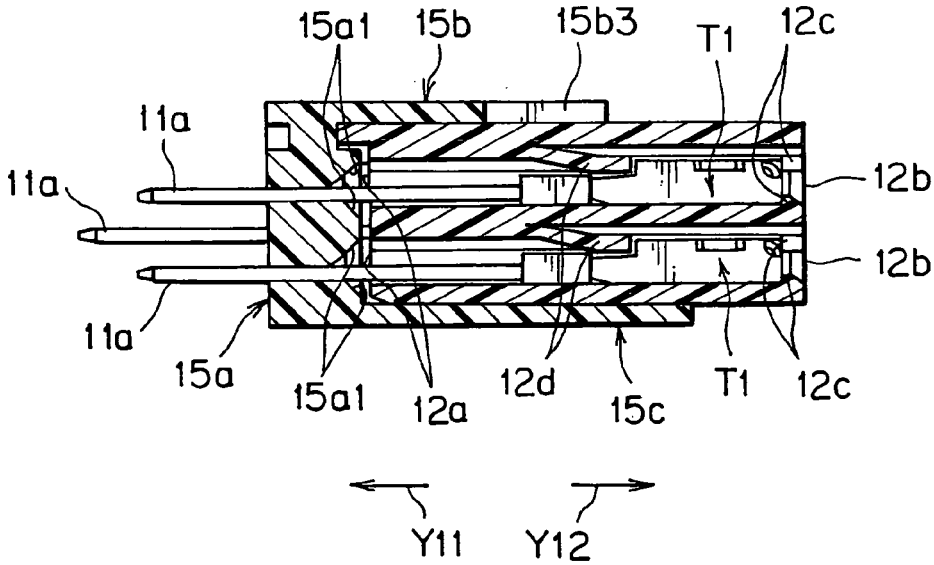
FIG. 6B is a sectional view taken along line VI-VI of FIG. 6A.
Figure 7:
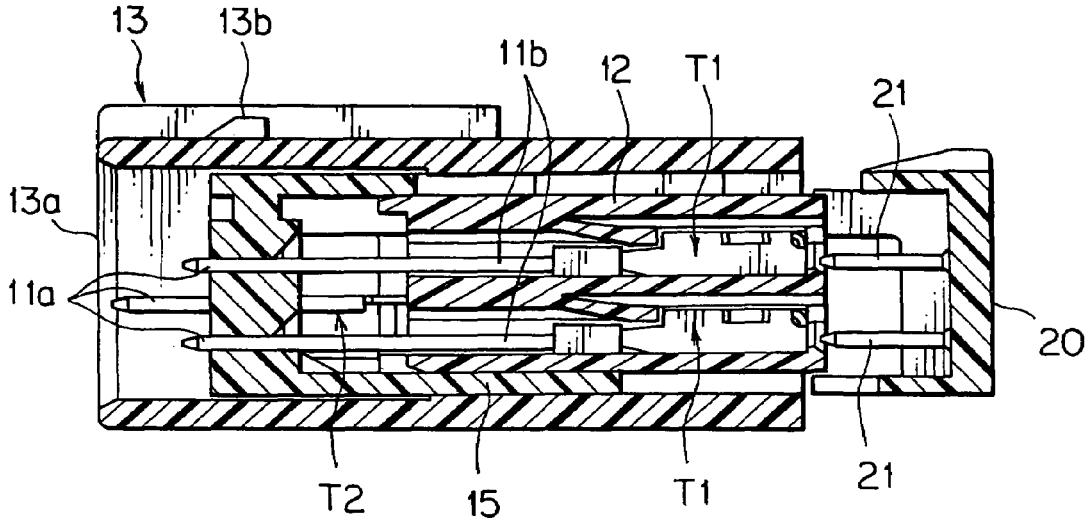
FIG. 7 is a sectional view showing an assembling process of the connector.
Figure 8:
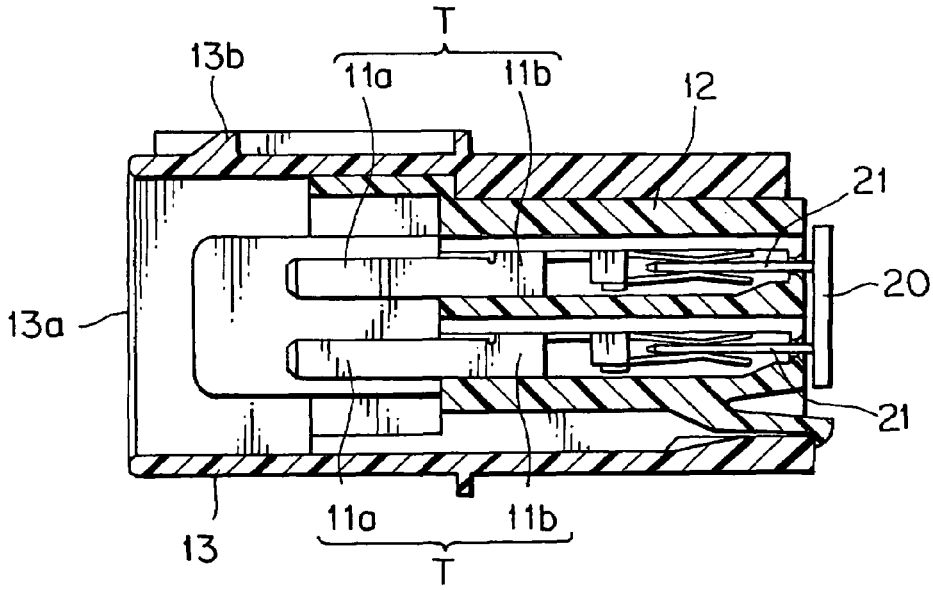
PRIOR ART FIG. 8
FIG. 8 is a sectional view showing a conventional connector.
Figure 9:
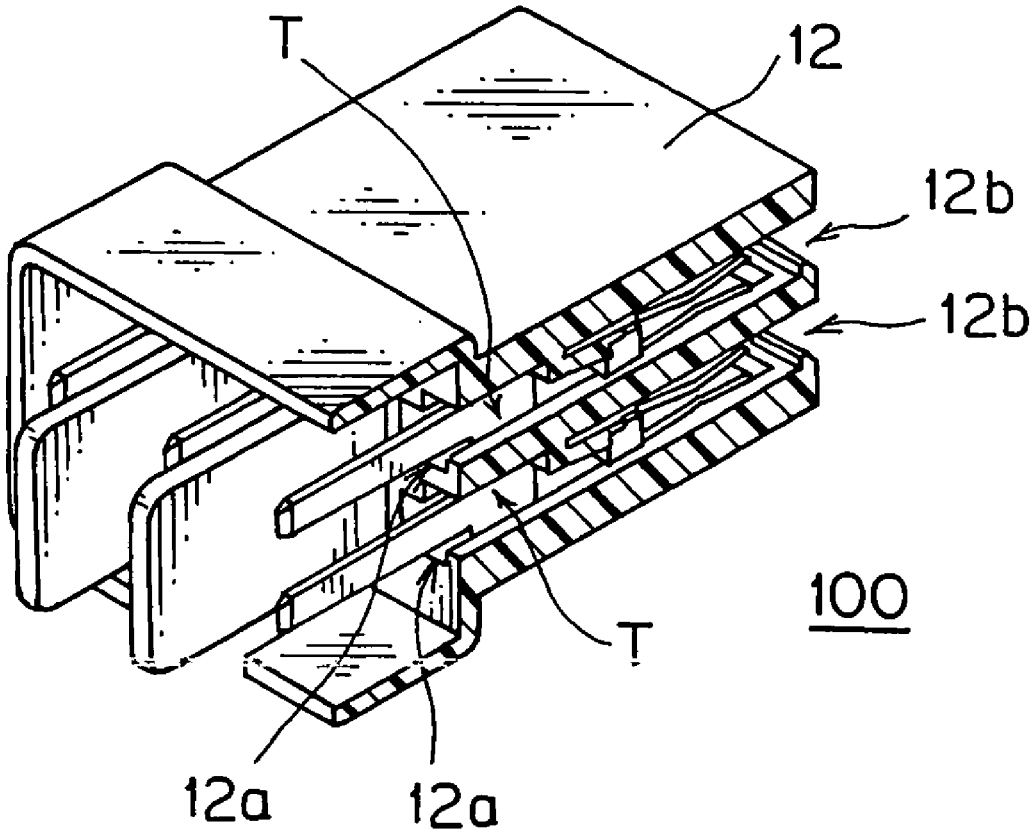
PRIOR ART FIG. 9
FIG. 9 is a perspective view showing the conventional connector of FIG. 8 and a section of a connector housing body.

FIG. 4A is a perspective view showing a front body 15 constituting the connector 10, and FIG. 4B is a sectional view taken along line II-II of the front body 15 of FIG. 4A. FIG. 5A is a perspective view showing the front body 15 preliminarily locked to the housing body 12, and FIG. 5B is a sectional view taken along line IV-IV of the housing body 12 and the front body 15 of FIG. 5A. FIG. 6A is a perspective view showing the front body 15 finally locked to the housing body 12, and FIG. 6B is a sectional view taken along line VI-VI of FIG. 6A. FIG. 7 is a sectional view showing an assembling process of the connector 10.

As shown in FIG. 1, the connector 10 of the embodiment will be discussed as one example, which connects a female connector (not shown) to a male terminal 21 (FIG. 7) projected from a base plate 20. As illustrated in the drawing, the connector 10 has the housing body 12 provided with terminal receiving chambers C1, C2 (FIGS. 3A, 3B), a smaller thickness terminal T1, and a larger thickness terminal T2.

Each of the smaller thickness terminal T1 and the larger thickness terminal T2 has a terminal base 11*b* received in the terminal receiving chamber C1 or C2 and a projection portion 11*a* projecting from an opening 12*a* (FIG. 3B) of the housing body 12. As illustrated in FIGS. 2A, 2B, each of the smaller thickness terminal T1 and the larger thickness terminal T2 has a male terminal part in the side of the projection portion 11*a* and a female terminal part in the side of the terminal base 11*b* respectively. The male terminal part engages with a female terminal of the opposed female connector. The female terminal part engages with the male terminal 21 via an opening 12*b* (FIG. 3B). Comparatively referring to FIGS. 2A and 2B, the smaller thickness terminal T1 has the projection portion 11*a* of a sectional area smaller than that of the larger thickness terminal T2.

As shown in FIGS. 3A, 3B, the housing body 12 is generally a box having four terminal receiving chambers C1 receiving the smaller thickness terminals T1 and two terminal receiving chambers C2 receiving the larger thickness terminals T2. Each terminal receiving chamber C1 is provided with a protrusion 12*c* and terminal locking lance 12*d*. The protrusion 12*c* locks an end of a receiving side Y12 of the received smaller thickness terminal T1, and the terminal locking lance 12*d* locks a locking shoulder 11*c* (FIG. 2A) of the smaller thickness terminal T1.

The terminal locking lance 12*d* is flexible. The terminal locking lance 12*d* is extended toward the receiving side Y12 and inclined toward a center of the terminal receiving chamber C1. Like the terminal receiving chamber C1, the terminal receiving chamber C2 receiving the larger thickness terminal T2 has a locking protrusion (not shown) and a terminal locking lance (not shown).

Next, a process for inserting the smaller thickness terminal T1 into the terminal receiving chamber C1 of the housing body 12 will be discussed. The smaller thickness terminal T1 is inserted from the projection opening 12*a* into the terminal receiving chamber C1 along a partition wall of the terminal receiving chambers C1 through the receiving side Y12. When an end of the receiving side Y12 of the smaller thickness terminal T1 reaches the housing body 12, the terminal locking lance 12*d* deflects upward in the illustrating drawing. A further advancement of the smaller thickness terminal T1 into the receiving side Y12 locks an opposed end of the receiving side Y12 by a protrusion 12*c*.

A further advancement of the smaller thickness terminal T1 toward the receiving side Y12 positions a locking shoulder 11*c* to pass the terminal locking lance 12*d* so that the terminal locking lance 12*d* moves downward by its resiliency to lock the locking shoulder 11*c*. Accordingly, the projection portion 11*a* of the smaller thickness terminal T1 projects from the opening 12*a* of the terminal receiving chamber C1, and the terminal base 11*b* is received in the terminal receiving chamber C1.

The locking of the protrusion 12*c* and the terminal locking lance 12*d* retains the smaller thickness terminal T1 in the terminal receiving chamber C1, and the smaller thickness terminal T1 is drawn out neither toward the receiving side Y12 nor toward a projection side Y11. Like the smaller thickness terminal T1, the larger thickness terminal T2 is inserted into the terminal receiving chamber C2. Thus, the insertion process of the larger thickness terminal T2 will not be discussed in detail.

As shown in FIG. 1, each of the smaller thickness terminal T1 and the larger thickness terminal T2 is received in each of the terminal receiving chamber C1 and C2 such that a leading end of the projection portion 11*a* of the smaller thickness terminal T1 is positioned at the rear of that of the projection portion 11*a* of the larger thickness terminal T2.

As shown in FIG. 1, the connector 10 has the front body 15 for covering the projection side Y11 of the smaller thickness terminal T1 and the larger thickness terminal T2. The front body 15 has terminal insertion holes H (FIGS. 4A, 4B) through which the projection portions 11*a* (FIGS. 2A, 2B) of the terminals T1, T2 pass. Furthermore, the case 13 is provided for receiving the housing body 12 and the front body 15.

As shown in FIGS. 3A, 3B, the housing body 12 has an outer side surface on which a guide bar 12*e* is formed along a longitudinal direction Y1 of the smaller thickness terminal T1 and the larger thickness terminal T2 for guiding the guide bar 12*e*. The guide bar 12*e* has an end positioned in the receiving side Y12, which is a final locking shoulder 12*e*1 (locking means) for locking the front body 15. Furthermore, the guide bar 12*e* has a preliminary locking shoulder 12*e*2 (locking means) positioned more toward the projection side Y11 than the final locking shoulder 12*e*1 to preliminarily lock the front body 15.

Furthermore, the front body 15, as shown in FIGS. 4A, 4B, has a face block 15*a* and cover portions 15*b*, 15*c*. The cover portions 15*b*, 15*c* cover outer surfaces of the housing body 12. The face block 15*a* is formed with four terminal insertion holes H for inserting the smaller thickness terminals T1 and two terminal insertion holes H for inserting the larger thickness terminals T2.

The cover portion 15*b* is formed with a guide channel 15*b*1 receiving the guide bar 12*e* along the longitudinal direction Y1 of the smaller thickness terminal T1 and the larger thickness terminal T2. The cover portion 15*b* also has a lock arm 15*b*3 formed with a locking hook 15*b*2 protruding toward the guide channel 15*b*1. The cover portion 15*c* has a lock arm 15*c*2 formed with a locking hook 15*c*1 for locking the case 13.

As shown in FIG. 4B, the terminal insertion holes H each have an inner surface formed with a taper 15*a*1 at an end portion positioned in the receiving side Y12 such that a sectional area of the hole H progressively decreases toward the projection side Y11.

Next, a mounting process of the front body 15 in the housing body 12 having received the smaller thickness terminal T1 and the larger thickness terminal T2 will be discussed. The front body 15 is coupled to the housing body 12 from the projection side Y11 while the guide channel 15*b*1 receives the guide bar 12*e* of the housing body 12. Guided by the guide channel 15*b*1 and the guide bar 12*e*, the front body 15 is mounted on the housing body 12 to be moved from the projection side Y11 toward the receiving side Y12.

When the leading end of the projection portion 11*a* of the larger thickness terminal T2 reaches a terminal base side opening of the terminal insertion hole H of the front body 15, the leading end of the projection portion 11*a* of the larger thickness terminal T2 is aligned along the taper 15*a*1 to be inserted into the terminal insertion hole H. Then, the leading end of the projection portion 11*a* of the smaller thickness terminal T1 reaches a terminal base side opening of the terminal insertion hole H of the front body 15. The leading end of the projection portion 11*a* of the smaller thickness terminal T1 is aligned along the taper 15*a*1 to be inserted into the terminal insertion hole H. Thereafter, the locking hook 15*b*2 of the lock arm 15*b*3 of the front body 15 reaches the preliminary locking shoulder 12*e*2 of the guide bar 12*e*, so that the locking hook 15*b*2 of the front body 15 locks to the final locking shoulder 12*e*1 of the housing body 12 as shown in FIG. 5A.

Thereby, the front body 15 preliminarily locks to the housing body 12. At the preliminary locking position, as shown in FIG. 5B, the leading end of the projection portion 11*a* of the smaller thickness terminal T1 is positioned at a projection opening H1 of the terminal insertion hole H. Meanwhile, the leading end of the projection portion 11*a* of the larger thickness terminal T2 extends a little from the opening H1 of the terminal insertion hole H. In the preliminary locking state, the housing body 12 with the front body 15 is packaged and transferred.

As shown in FIG. 1, the case 13 is generally defined in a pipe shape and has a locking protrusion 13*b* on its an outer surface for engaging a connector housing of an opposed male connector. The case 13 is mounted on the housing body 12 with the front body 15 being in the preliminary locking state. That is, the housing body 12 with the front body 15 being in the preliminary locking state is inserted into the case 13 from the projection opening 13*a* of the case 13. When the housing body 12 is inserted into the case 13 up to the position shown in FIG. 1, the cover portion 15*c* of the housing body 12 locks to a locking portion (not shown) of the case 13 to engage the housing body 12 with the case 13.

From this state, the front body 15 is pushed to move it from the projection side Y11 to the receiving side Y12, so that the locking hook 15*b*2 of the front body 15 releases from the preliminary locking shoulder 12*e*2 of the housing body 12 and the front body 15 engages with the housing body 12 more deeply toward the receiving side Y12 as shown in FIG. 7.

The front body 15 is further pushed toward the housing body 12 from the projection portion 11*a* to the terminal base 11*b*, so that the locking hook 15*b*2 of the lock arm 15*b*3 of the front body 15 reaches the final locking shoulder 12*e*1 of the guide bar 12*e* and the locking hook 15*b*2 locks to the final locking shoulder 12*e*1 as shown in FIG. 6A. At this final locking position, as shown in FIG. 6B, the leading ends of the projection portions 11*a* of the smaller thickness terminal T1 and the larger thickness terminal T2 extend from the terminal insertion holes H.

As best shown in FIGS. 6A, 6B, the leading ends of the projection portions 11*a* of the smaller thickness terminal T1 and the larger thickness terminal T2 project from the terminal insertion holes H. Meanwhile, at the preliminary locking position shown in FIGS. 5A, 5B, the leading ends of the projection portions 11*a* of the smaller thickness terminals T1 are positioned at the projection openings H1 of the terminal insertion holes H and within the receiving side Y12. That is, the leading ends of the projection portions 11*a* of the smaller thickness terminals T1 are positioned rearward from a point P1 corresponding to the final locking position of the smaller thickness terminal T1.

Likewise, at the preliminary locking position, as shown in FIG. 5B, the leading end of the projection portion 11*a* of the larger thickness terminal T2 is positioned rearward from a leading point P2 where the projection portion 11*a* of the larger thickness terminal T2 is positioned at the final locking position.

The connector 10, as shown in FIGS. 5A, 5B the smaller thickness terminal T1 does not project from the terminal insertion hole H of the front body 15 at the preliminary locking position. Meanwhile, the larger thickness terminal T2 projects a little from the terminal insertion hole H. Thereby, at the preliminary locking position, the smaller thickness terminal T1 having a smaller sectional area and being weak against an impact force does not extend from the terminal insertion hole H. This prevents deformation of the smaller thickness terminal T1 during packaging and transportation thereof. Meanwhile, the larger thickness terminal T2 has a sectional area remarkably larger than that of smaller thickness terminal T1 so as to have a strength enough to resist to an impact force. Thus, the projection portion 11*a* of the larger thickness terminal T2 extending a little from the terminal insertion hole H will not be deformed during packaging and transportation thereof. The larger thickness terminal T2 extended from the terminal insertion hole H reduces a distance from the receiving side Y12 to the front body 15, minimizing the connector 10.

In the connector 10, the preliminary locking shoulder 12*e*2 of the housing body 12 and the locking hook 15*b*2 of the front body 15 preliminarily locks the front body 15 to the housing body 12. As shown in FIG. 5B, at the preliminary locking position, the leading end of the projection portion 11*a* of the smaller thickness terminal T1 is positioned at the opening H1 of the terminal insertion hole H. Thus, at the preliminary locking position, the smaller thickness terminal T1 does not extend from the terminal insertion hole H of the front body 15, while a distance from the receiving side Y12 of the housing body 12 to the front body 15 is minimized. This construction prevents deformation of the smaller thickness terminal T1 and the larger thickness terminal T2 during packaging and transportation thereof.

In the connector 10, the front body 15 has the cover portion 15*b* that protects the smaller thickness terminal T1 and the larger thickness terminal T2 in the preliminary locking state. Furthermore, the locking means are provided on the cover portion 15*b* and the housing body 12, which easily locks the front body 15 to the housing body 12. This construction prevents deformation of the smaller thickness terminal T1 and the larger thickness terminal T2 during packaging and transportation thereof.

In the connector 10, the terminal insertion hole H has an inner periphery formed with a tapered surface taper 15*a*1 to define an open sectional decreasing along an insertion direction of the projecting terminal, the tapered surface positioned in a side of the terminal receiving chamber. Thereby, the projecting terminal is aligned with and inserted into the tapered inner peripheral surface taper 15*a*1 of the terminal insertion hole H so that the smaller thickness terminal T1 and the larger thickness terminal T2 can be easily aligned with and passed through the terminal insertion holes H.

In the embodiment, at the preliminary locking position, the smaller thickness terminal T1 does not extend from the terminal insertion hole H while the larger thickness terminal T2 extends a little from the terminal insertion hole H. However, alternatively, at the preliminary locking position, the smaller thickness terminal T1 and the larger thickness terminal T2 may be extended from the terminal insertion holes H while the leading ends of the projection portions 11*a* of the smaller thickness terminal T1 and the larger thickness terminal T2 do not come forward from the leading points P1, P2 of the projection portions 11*a* of the smaller thickness terminal T1 and the larger thickness terminal T2 at the final locking position.

As discussed above, even when the smaller thickness terminal T1 and the larger thickness terminal T2 extend from the terminal insertion holes H at the preliminary locking position, the extended lengths are shorter than at the final locking position. Thus, the connector 10 can be packaged and transported in the preliminary locking state without deformation of the smaller thickness terminal T1 and the larger thickness terminal T2 because of the extended lengths of smaller thickness terminal T1 and the larger thickness terminal T2 shorter than at the final locking position.

Alternatively, at the preliminary locking position, both the smaller thickness terminal T1 and the larger thickness terminal T2 may be positioned not to extend from the terminal insertion holes H. That is, at the preliminary locking position, the leading end of the projection portion 11*a* of the larger thickness terminal T2 also is positioned in the opening H1 of the terminal insertion hole H or in the receiving side Y12.

Further alternatively, at the preliminary locking position, the leading end of the projection portion 11*a* of the smaller thickness terminal T1 may be positioned not in the opening H1 but in the receiving side Y12 while the leading end of the projection portion 11*a* of the larger thickness terminal T2 is positioned not in the opening H1 but in the projection side Y11.

In the embodiment, the projecting terminal has the male terminal part in the side of the projection portion 11*a* and the female terminal part in the side of the terminal base 11*b*. The projecting terminal of the present invention is not limited in the aforementioned type but may not have a female terminal part or may be directly connected to an electrical cable in the side of the terminal base 11*b*.

In the embodiment, the housing body 12 has the preliminarily locking shoulder 12*e*2 and the final locking shoulder 12*e*1. Alternatively, such locking means may be positioned in the front body 15.

In the embodiment, the locking means are provided on the outer surface of the housing body 12 and in the cover portion 15*b* of the front body 15. Alternatively, another locking means may be provided, to lock the front body 15 to the housing body 12 at the preliminary locking position and at the final locking position.

Note that the discussed embodiments are representative aspects of the present invention and do not limit the present invention. Those skilled in the art field will be able to provide another embodiment within the spirit of the present invention.

What is claimed is:

1. An electrical connector comprising:

a housing body having a terminal receiving chamber, a projecting terminal having a terminal base received in the terminal receiving chamber and a projecting portion projecting from the housing body, a front body having cover portions for covering an outer side surface of the housing body and having a terminal insertion hole through which the projecting portion of the projecting terminal is extended, locking means provided in the housing body and the front body for finally locking the front body to the housing body at a final locking position where the projecting portion of projecting terminal is extended from the insertion hole when the front body is moved from the projecting portion toward the terminal base to be attached to the housing body, the locking means preliminarily locking the front body to the housing body at a preliminary locking position where a leading end of the projecting portion of the terminal is positioned with a less distance from the front body than at the final locking position, and a case for receiving the housing body and the front body and engaging with an opposed connector housing having an opposed terminal, wherein the cover portions of the front body surround and protect the projecting portion of the projecting terminal from an impact force when the housing body and the front body are at the preliminary locking position, a larger thickness one and a smaller thickness one of the projecting terminals are received in the terminal receiving chambers, the smaller thickness terminal being smaller than the larger thickness terminal in sectional area, the leading end of the projecting portion of the larger thickness terminal extended from the terminal insertion hole while the leading end of the smaller thickness terminal is not extended from the terminal insertion hole at the preliminary locking position where the front holder is preliminarily locked to the housing body by the locking means.

2. The electrical connector recited in claim 1 wherein the locking means are configured such that the leading end of the projecting terminal is positioned not to extend from the terminal insertion hole at the preliminary locking position where the front body is preliminarily locked to the housing body.

3. The electrical connector recited in claim 1 wherein the locking means are configured such that the leading end of the projecting terminal is positioned in the terminal insertion hole at the preliminary locking position where the front body is preliminarily locked to the housing body.

4. The electrical connector recited in claim 1 wherein the locking means are separately provided in one of the cover portions of the front body and in the outer side surface of the housing body.

5. The electrical connector recited in claim 1 wherein the terminal insertion hole has an inner periphery formed with a tapered surface to define an open sectional area decreasing along an insertion direction of the terminal, the tapered surface positioned in a side of the terminal receiving chamber.

* * * * *